United States Patent [19]

Yang

[11] Patent Number: 4,969,561

[45] Date of Patent: Nov. 13, 1990

[54] DIARY REMINDER DEVICE FOR DOCUMENTS, LETTERS, AND THE LIKE

[76] Inventor: Elmer C. Yang, 2717 E. Grove Ave., Orange, Calif. 92667

[21] Appl. No.: 402,553

[22] Filed: Sep. 5, 1989

[51] Int. Cl.[5] ..... A47F 1/04

[52] U.S. Cl. ..... 211/59.2; 211/120; 221/75

[58] Field of Search ..... 211/120, 1.5, 11, 59.2; 221/75

[56] References Cited

U.S. PATENT DOCUMENTS

| | | | |
|---|---|---|---|
| 1,134,988 | 4/1915 | Bellinger | 211/120 X |
| 2,279,643 | 4/1942 | Silver | 211/120 X |
| 2,619,233 | 11/1952 | Weiskopf | 211/120 X |
| 4,312,460 | 1/1982 | Boettcher | 221/75 |
| 4,600,119 | 7/1986 | Olson | 221/75 |
| 4,844,294 | 7/1989 | Albright | 221/75 |

*Primary Examiner*—Blair M. Johnson
*Attorney, Agent, or Firm*—Willie Krawitz

[57] ABSTRACT

A timed, rotating coil device is provided to advance documents, letters, and the like which are positioned between adjacent coil elements. The coil is flexible to accommodate for different sized documents, letters, etc., between each coil element, and is supported at one end by a timer and at the other end by a coil clamp. This support arrangement eliminates the need for a central support, and together with the coil flexibility, enables the coil to accommodate both for letter size and document thickness. The number of coil element spacings is calculated to coincide with a given time period, typically twenty-four hours. The last coil element is provided with a bent portion to eject the document when it arrives at the end of the coil spacings. Thus, the presence of an ejected document indicates it is ready to be acted upon.

5 Claims, 1 Drawing Sheet

DIARY REMINDER DEVICE FOR DOCUMENTS, LETTERS, AND THE LIKE

BACKGROUND OF THE INVENTION

This invention relates to a new and improved reminder device for documents, letters, etc., which functions in a simple and efficient manner. The device utilizes an electrically driven, rotatable, flexible coil providing a plurality of coil members defining spaces between each coil member.

Various devices for handling mail,display, storage, and delivery of relatively flat packages of this type are known, and typical patents showing these types are to be found in U.S. Pat. Nos. 970,103; 2,279,643; 3,203,589; 3,464,588; 3,057,511; 4,143,791; 4,314,418; and, 4,801,022.

However, none of these prior art devices provide a timed reminder for the due date of a document, e.g., mailing of a letter, payment of a bill, etc. Also, none of these prior art devices make provision for documents, letters, etc., which have differing thicknesses and sizes.

THE INVENTION

According to the invention, there is provided an improved reminder device for documents, letters, and the like in which the electrically driven coil is rotatably driven by a timed motor which advances the individual coil members so that a given number of these coils arrives at the end of the coil within a specific time period. The coil is sufficiently flexible to enable documents having differing thicknesses to be readily inserted between the coil members. Also, the coil is rotatably supported at each end, rather from a central axial support, and this permits use of a flexible, rather than a rigid coil.

Moreover, elimination of the central support for the coil enables a large document to be inserted between the coil members rather than restricting the coil members to accommodate for a smaller sized document.

The last coil element of the coil forms a bend, so that when a document arrives at the end of the coil, it will be contacted by the bend and be ejected from the device. Hence, the user can easily see if a document requires some action to be taken, simply by the fact of its removal from the device. In addition, during operation of the device, i.e., when a document is moved forward from its initial position, its progress can be noted, and the user's potential work load can be readily determined. Obviously, a document can be readily inserted into the device out of sequence with other documents which may have been previously inserted in between the coil members.

DESCRIPTION OF THE PREFERRED EMBODIMENT

Figure 1:
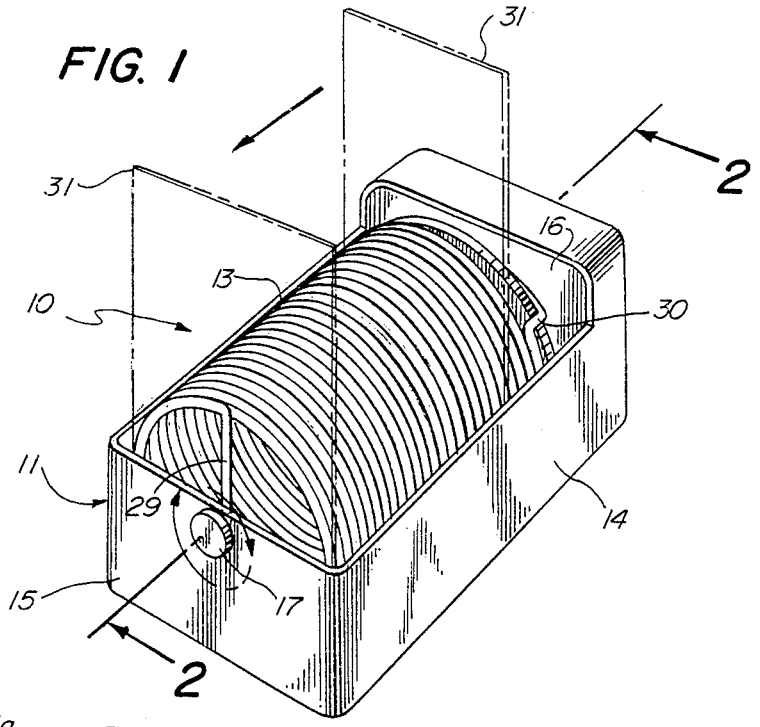
FIG. 1 is an upper perspective view of the reminder device of this invention.
Figure 3:
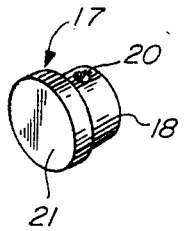
FIG. 3 is a perspective view of one coil holder rotatably mounted at one end of the device; and, FIG. 4 is a perspective view of a driving coil holder mounted at the other end of the device.

The reminder device 10 of this invention is shown in FIG. 1, and comprises an integrally formed coil supporting case member 11 preferably of injection molded plastic, which provides a bottom portion 12, side walls 13, 14, and end members 15, 16. The end member 16 is shaped as an enclosure portion **16*a*, and provides an inwardly extending circular portion 16*b*. Rotatably mounted within the end member 15 is a coil holding element 17 having a cylindrically shaped end 18 which fits into a bore 19 in the end member 15. A recess 20 is formed in the cylindrical end 18 to engage the front end of the coil. The front end 21 of the coil holding element 17 functions as a retaining stop as it rotates against the end member 15**.

Figure 4:
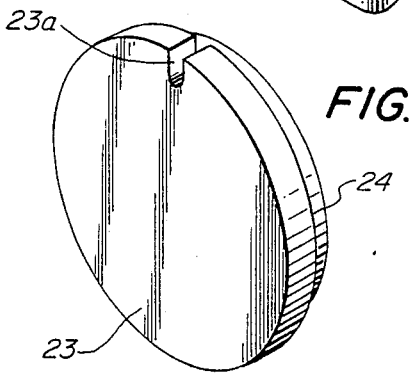
Figure 2:
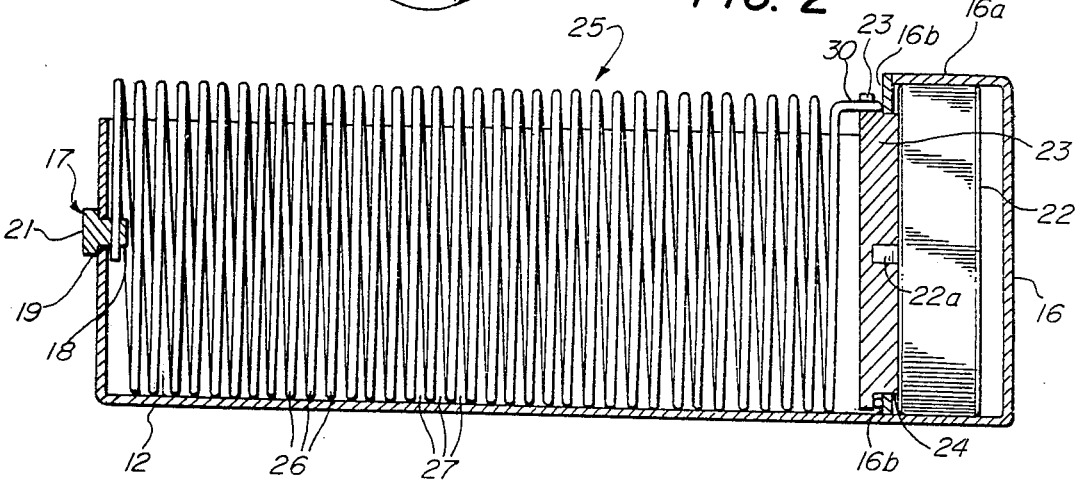
FIG. 2 is a sectional side elevation view of the device, taken along lines 2—2 of FIG. 1.

As shown in FIG. 2, a coil driving, battery powered element 22 having a centrally mounted drive rod **22*a* is mounted within the enclosure portion 16*a* of the end member 16. An adaptor element 23 is mounted within the circular portion 16*b* of the end member 16, and attached to the drive rod 22*a*. As shown in FIG. 4, the adaptor element 23 defines a slot 23*a*, and a circular shoulder 24 to engage the rear drive end of the coil. Preferably, the cylindrical end 18 of the coil holding element 17 and the centrally mounted drive rod 22*a* of the coil driving element 22** are axially aligned.

A flexible, document moving coil 25 is mounted within the case member 11, and provides a plurality of individual coil elements 26, each of the coil elements having spaces 27 therebetween. At the front or delivery end of the coil, the coil end bends to form an extension 29 which engages the recess 20 of the of the cylindrically shaped end 18. At the drive end, the coil 25 provides a coil extension which forms a bend portion 30 that engages the slot **23*a* of the adaptor element 23. As indicated, the coil end forms an extension 30*a* which is secured along the circular shoulder 24**.

In operation, when the coil driving element 22 is turned on, it will rotate the coil 25, and a letter 31 positioned in a coil element space 27 between adjacent coil elements, will be advanced along the coil towards the driving end. Inasmuch as the coil is flexible, it is quite easy to simply flex the coil and insert a document in a space, irrespective of whether the document, letter, etc., is thin or comparatively thicker than usual. Also, the diameter of the coil, which is of the order of about 1½" to about 4", enables most documents, letters, etc., to be easily accommodated by the coil. The height of the sidewall 14 will prevent the letter 31 from tipping over on its side and will maintain it in an upright position, during its movement.

When the letter arrives at the bend portion 30 of the coil, it will be contacted by the bend 30, and will be ejected out of the coil and over the wall 14 for disposition by the user. The document obviously can be inserted at some intermediate point along the coil for ejection at a predetermined disposition date by the device. Also, it is quite simple to determine from the loading of documents on the coil, what work load will be arriving for ejection in a given period of time.

Moreover, by marking a letter with a location number corresponding to the arrival time of a letter at the end of the coil, insertions of additional documents or letters into the coil can be based on the location of the previously inserted letter. This saves the trouble of counting coil spacings.

The reminder device of this invention has a simple and inexpensive construction and is easily workable; also, it can be readily monitored for work load, and the addresses or nature of documents to be handled.

I claim:

1. A reminder device for documents, letters, and the like, comprising:

(a) a coil supporting case, providing front and drive end supports for a flexible coil, and a support sidewall to maintain the documents, letters, and the like in an upright position;

(b) a timed coil driving motor means mounted at the drive end support, for supporting and rotating the coil, during a given time period and a rotatable coil support means mounted at the front end support, the coil driving means and the coil support means being axially aligned;

(c) a flexible, spiral coil having a circular cross section, and providing individual coil elements which define spaces therebetween for insertion of documents, letters, and the like into the spaces for movement along the spiral coils as the coil is being rotated, the number of coil elements being calculated to coincide with a given time period, the spiral coil providing a first end portion which is mounted by the coil driving means, and a second end portion which is mounted on the coil support means, a bend portion being defined by a coil element to contact and eject a document, letter, and the like over the support sidewall when the document arrives near one end of the coil, the flexibility of the coil being sufficient to enable the coil elements to be flexed and expanded, and thereby permit documents, letters, and the like of different thicknesses to be inserted into the spaces, the entire circular cross section of the coil being available to accommodate the said document, letter, and the like.

2. The reminder device of claim 1, in which the coil driving means is mounted on an adaptor, and the first end portion of the coil is mounted on the adaptor.

3. The reminder device of claim 1, in which the coil supporting case is integrally formed of injection molded plastic.

4. The reminder device of claim 1, in which the coil driving means is a battery-driven, timed motor.

5. A method for reminding the due date of documents, letters, and the like, comprising:

(a) supporting a flexible coil in a coil supporting case, having front and drive end supports for the coil, and a support sidewall to maintain the documents, letters, and the like in an upright position;

(b) supporting and rotating the coil at one end by a timed coil driving motor means during a given time period, the timed motor being mounted at the drive end support of the coil supporting case, and supporting the coil at the other end by the rotatable front end support of the coil supporting case, the coil driving means and the coil support means being axially aligned;

(c) the flexible coil having a circular cross section, having individual coil elements which define spaces therebetween for insertion of documents, letters, and the like into the spaces for movement along the spiral coils as the coil is being rotated, the number of coil element spacings being calculated to coincide with a given time period, a bend portion being defined by a coil element to contact and eject a document, letter, and the like over the support sidewall when the document arrives near one end of the coil, the flexibility of the coil being sufficient to enable the coil elements to be flexed and expanded, and thereby permit documents, letters, and the like of different thicknesses to be inserted into the spaces, the entire circular cross section of the coil being available to accommodate the said document, letter, and the like.

* * * * *